US007156325B1

(12) United States Patent
Chen

(10) Patent No.: US 7,156,325 B1
(45) Date of Patent: Jan. 2, 2007

(54) SPRAYING GUN

(75) Inventor: Chin-Yuan Chen, Changhua Hsien (TW)

(73) Assignee: Shin Tai Spurt Water of the Garden Tools Co., Ltd., Lu Kang Chen (TW)

( * ) Notice: Subject to any disclaimer, the term of this patent is extended or adjusted under 35 U.S.C. 154(b) by 91 days.

(21) Appl. No.: 11/028,024

(22) Filed: Jan. 3, 2005

(51) Int. Cl.
*A62C 31/02* (2006.01)

(52) U.S. Cl. ..... 239/394; 239/391; 239/525; 239/530; 239/532

(58) Field of Classification Search ..... 239/390, 239/391, 394, 525, 526, 530, 532
See application file for complete search history.

(56) References Cited

U.S. PATENT DOCUMENTS 6,216,965 B1 * 4/2001 Chao ..... 239/532
6,481,643 B1 * 11/2002 Chen ..... 239/394
6,585,174 B1 * 7/2003 Huang ..... 239/530
6,981,661 B1 * 1/2006 Chen ..... 239/532

* cited by examiner

*Primary Examiner*—Steven J. Ganey
(74) *Attorney, Agent, or Firm*—Alan D. Kamrath; Nikolai & Mersereau, P.A.

(57) ABSTRACT

A spraying gun includes a water guide pipe, a control unit, and an injection unit. The injection unit includes a water guide member, a water control plate, a water injection ring, and a shade. Thus, the control unit can control the water to flow into different water channels of the water guide pipe, and the injection unit has corresponding water inlet hole, water outlet hole, water filling hole and nozzle to align with the respective water channel of the water guide pipe, so that different kinds of water flow are injected outward from the nozzles of the injection unit so as to change the sprinkling manner of the spraying gun.

11 Claims, 6 Drawing Sheets

SPRAYING GUN

BACKGROUND OF THE INVENTION

1. Field of the Invention

The present invention relates to a spraying gun, and more particularly to a spraying gun having a control unit that can adjust the sprinkling manner of the spraying gun.

2. Description of the Related Art

A conventional spraying gun comprises a gun body having an inside formed with a water channel having a first end connected to a water inlet pipe and a second end connected to a nozzle having a plurality of water outlet holes. The water from the water inlet pipe is introduced into the water channel and is injected outward from the water outlet holes of the nozzle. However, the water from the water inlet pipe is injected outward from the water outlet holes of the nozzle constantly, so that the sprinkling manner of the conventional spraying gun is fixed and cannot be adjusted, thereby limiting the versatility of the conventional spraying gun.

Another conventional spraying gun comprises a water guide pipe having an inside formed with a guide channel, a water inlet portion mounted on a first end of the water guide pipe and formed with a water inlet hole connected to the guide channel of the water guide pipe, a control switch mounted on the water inlet portion, and a water outlet portion mounted on a second end of the water guide pipe and formed with a plurality of water outlet holes. In such a manner, the water from the water inlet hole of the water inlet portion passes through the guide channel of the water guide pipe and is ejected outward from selective ones of the water outlet holes of the water outlet portion.

However, when a user wishes to change the sprinkling manner of the conventional spraying gun, he has to rotate the water outlet portion relative to the water guide pipe to align the guide channel of the water guide pipe with other selective ones of the water outlet holes of the water outlet portion so as to change the sprinkling manner of the water outlet portion, thereby causing inconvenience to the user in changing and adjusting the sprinkling manner of the conventional spraying gun. In addition, the user has to touch the water outlet portion to change the sprinkling manner of the water outlet portion, so that the user's clothes are easily wetted by the water ejected from the water outlet holes of the water outlet portion.

SUMMARY OF THE INVENTION

In accordance with the present invention, there is provided a spraying gun, comprising a water guide pipe having an inside formed with a plurality of water channels, a control unit mounted on a first end of the water guide pipe, and an injection unit mounted on a second end of the water guide pipe, wherein:

the injection unit includes:

a water guide member mounted on the second end of the water guide pipe and having a first side formed with a plurality of water inlet holes each connected to a respective one of the water channels of the water guide pipe and a second side formed with a plurality of enlarged water outlet holes each connected to a respective one of the water inlet holes;

a water control plate mounted on the water guide member and formed with a plurality of water filling holes each connected to a respective one of the water outlet holes of the water guide member;

a water injection ring mounted on the water control plate and formed with a plurality of nozzles each connected to a respective one of the water filling holes of the water control plate.

The primary objective of the present invention is to provide a spraying gun, wherein the control unit at a proximate position can be used to control the sprinkling water of the injection unit at a distal position to change the sprinkling manner of the spraying gun.

Another objective of the present invention is to provide a spraying gun, wherein the control unit can control the water from the feeding member to flow into different water channels of the water guide pipe, and the injection unit has corresponding water inlet hole, water outlet hole, water filling hole and nozzle to align with the respective water channel of the water guide pipe, so that different kinds of water flow are injected outward from the nozzles of the injection unit so as to change the sprinkling manner of the spraying gun, thereby enhancing the versatility of the spraying gun, and thereby preventing the injected water from wetting a user's clothes.

A further objective of the present invention is to provide a spraying gun, wherein the sprinkling manner of the injection unit is adjusted and controlled by the control unit arbitrarily, thereby facilitating the user adjusting the sprinkling manner of the spraying gun.

Further benefits and advantages of the present invention will become apparent after a careful reading of the detailed description with appropriate reference to the accompanying drawings.

DETAILED DESCRIPTION OF THE INVENTION

Figure 1:
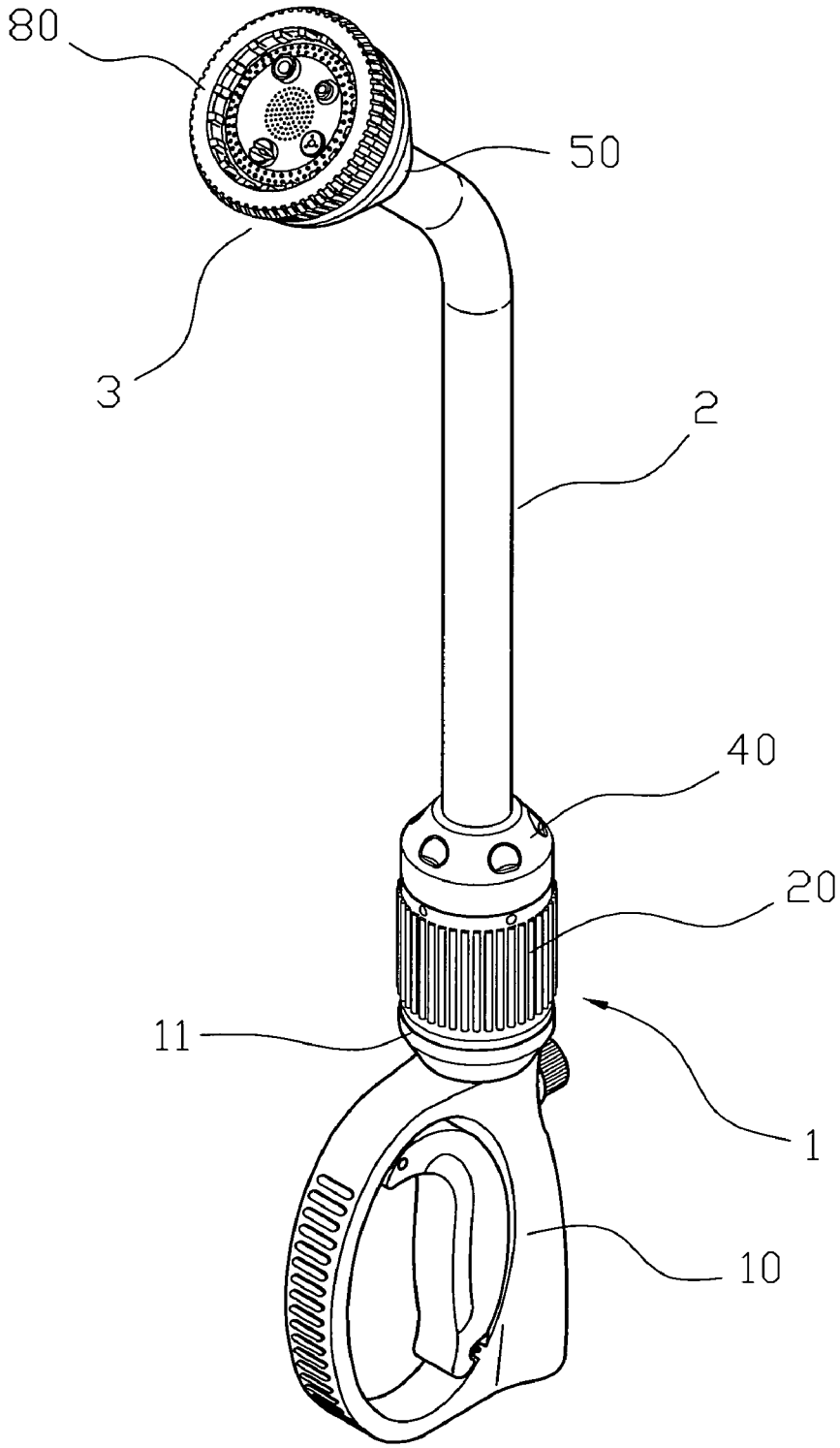
FIG. 1 is a perspective view of a spraying gun in accordance with the preferred embodiment of the present invention.
Figure 2:
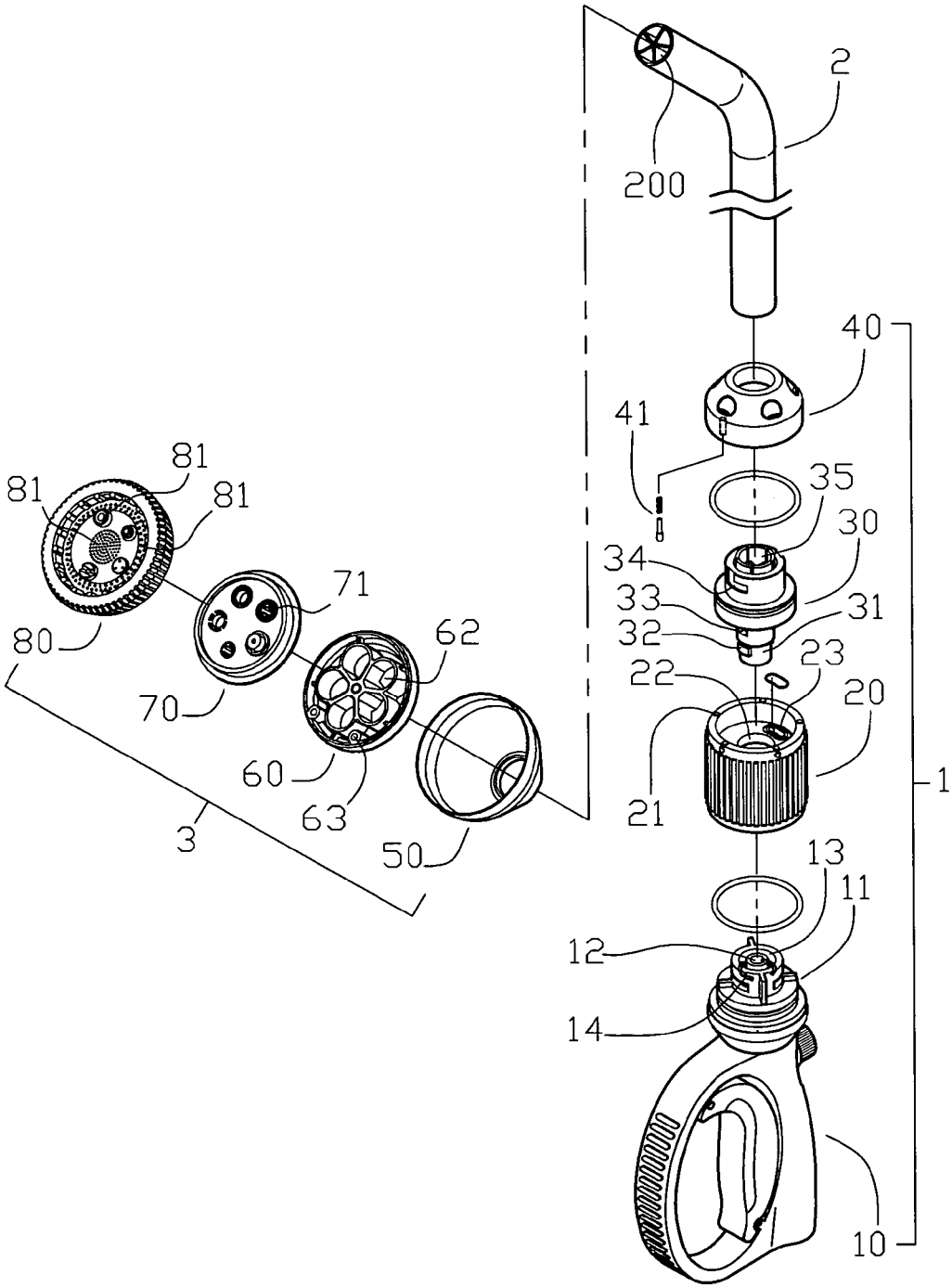
FIG. 2 is an exploded perspective view of the spraying gun as shown in FIG. 1.
Figure 3:
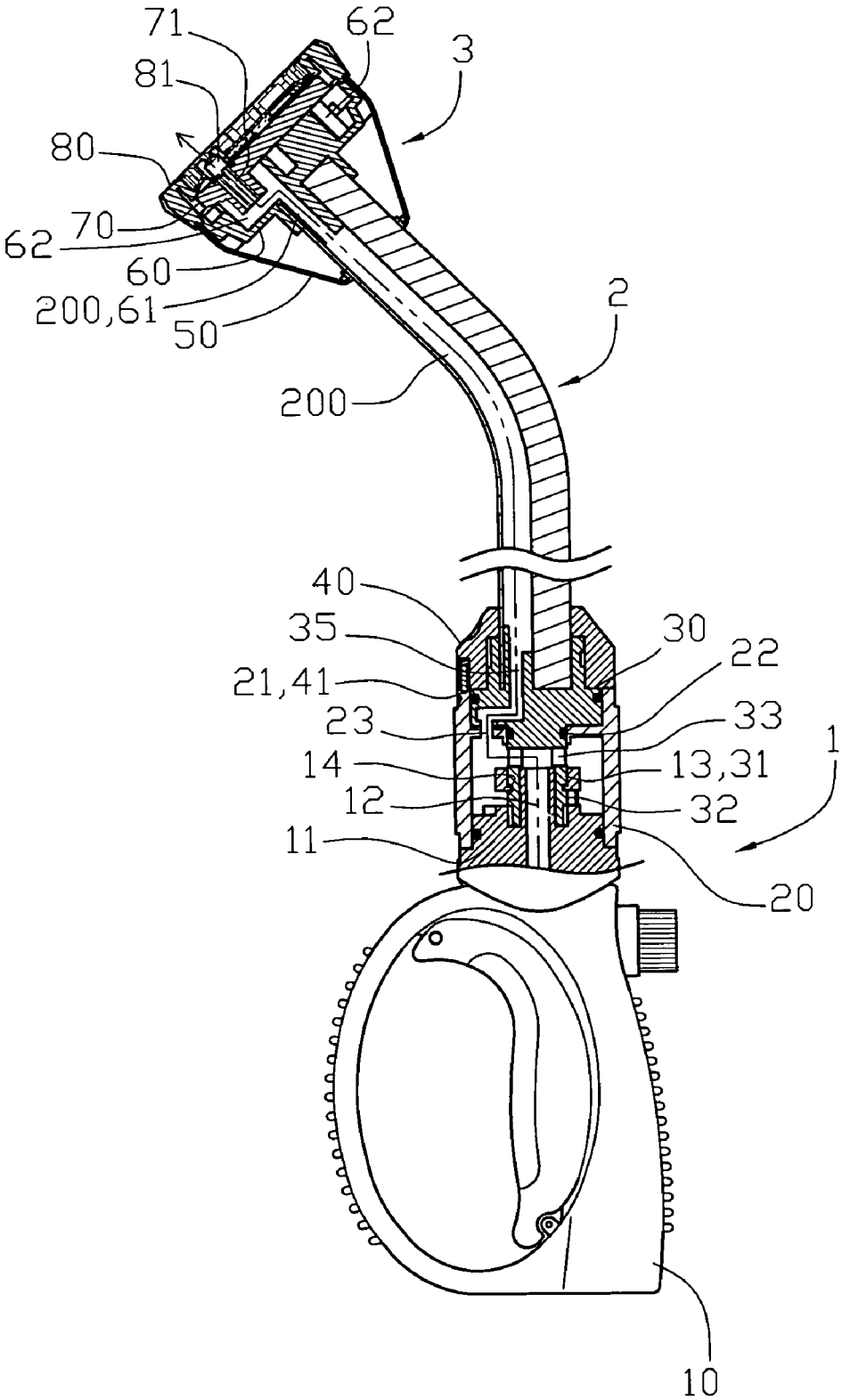
FIG. 3 is a partially cut-away plan cross-sectional view of the spraying gun as shown in FIG. 1.

Referring to the drawings and initially to FIGS. 1–3, a spraying gun in accordance with the preferred embodiment of the present invention comprises a water guide pipe 2 having an inside formed with a plurality of water channels 200, a control unit 1 mounted on a first end of the water guide pipe 2, and an injection unit 3 mounted on a second end of the water guide pipe 2.

The control unit 1 includes a feeding member 10, a fitting member 30, an adjusting member 20, and a jacket 40.

The feeding member 10 of the control unit 1 is connected to a water source (not shown) and has an end provided with a mounting portion 11 having an inside formed with a water outlet 12 and a periphery formed with an annular groove 13 having a locking cavity 14.

The fitting member 30 of the control unit 1 is mounted on the mounting portion 11 of the feeding member 10 and has a first end 31 inserted into the groove 13 of the mounting portion 11 of the feeding member 10 and formed with a water passage 33 connected to the water outlet 12 of the mounting portion 11 of the feeding member 10 and a second end mounted on the first end of the water guide pipe 2 and formed with a plurality of water conduits 35 each connected to a respective one of the water channels 200 of the water guide pipe 2. The first end 31 of the fitting member 30 of the control unit 1 has a locking block 32 locked in the locking cavity 14 of the groove 13 of the mounting portion 11 of the feeding member 10. The second end of the fitting member 30 of the control unit 1 has a periphery formed with a locking slot 34.

The adjusting member 20 of the control unit 1 is rotatably mounted on the first end 31 of the fitting member 30 and located between the feeding member 10 and the fitting member 30. The adjusting member 20 of the control unit 1 has an inside formed with a through hole 22 mounted on the first end 31 of the fitting member 30 and a periphery formed with at least one water conducting hole 23 connected to the water passage 33 of the fitting member 30 and selectively connected to either one of the water conduits 35 of the fitting member 30. The adjusting member 20 of the control unit 1 has an end formed with a plurality of positioning holes 21.

The jacket 40 of the control unit 1 is secured on the second end of the fitting member 30 by the locking slot 34 and has a bottom provided with a protruding positioning portion 41 detachably positioned in either one of the positioning holes 21 of the adjusting member 20.

In operation, when the adjusting member 20 of the control unit 1 is rotated, the water conducting hole 23 of the adjusting member 20 is moved with the adjusting member 20 and is selectively connected to either one of the water conduits 35 of the fitting member 30. In such a manner, the water from the water outlet 12 of the mounting portion 11 of the feeding member 10 in turn flows through the water passage 33 of the fitting member 30, the water conducting hole 23 of the adjusting member 20 and the selective one of the water conduits 35 of the fitting member 30 into a respective one of the water channels 200 of the water guide pipe 2, so that the water can flow through different water channels 200 of the water guide pipe 2.

Figure 4:
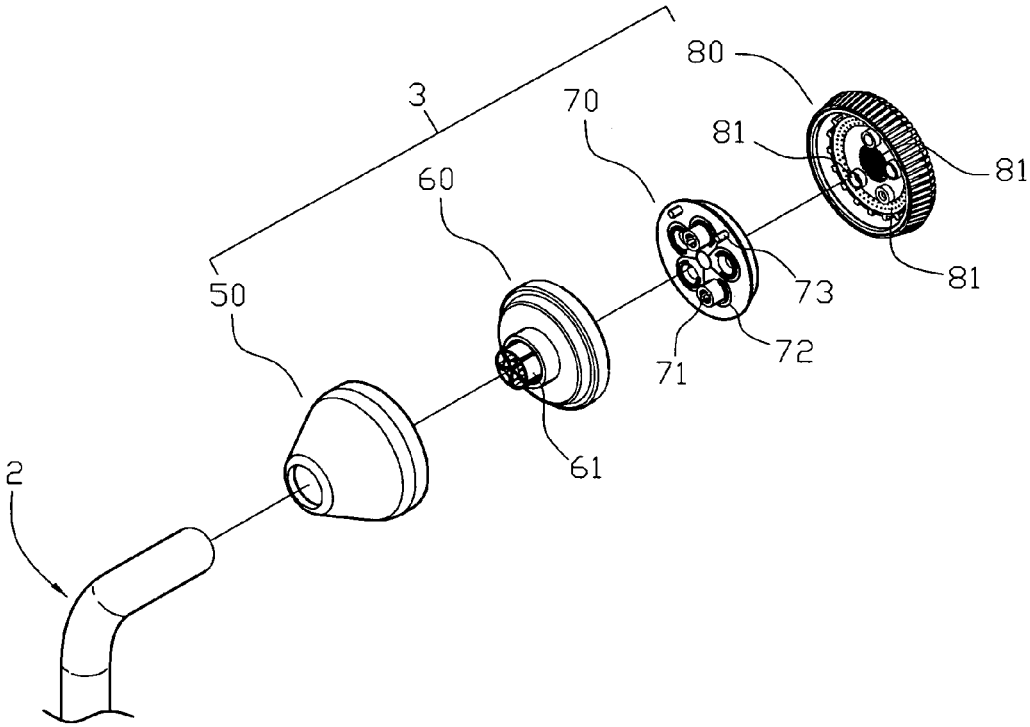
FIG. 4 is a partially exploded perspective view of the spraying gun as shown in FIG. 1.
Figure 5:
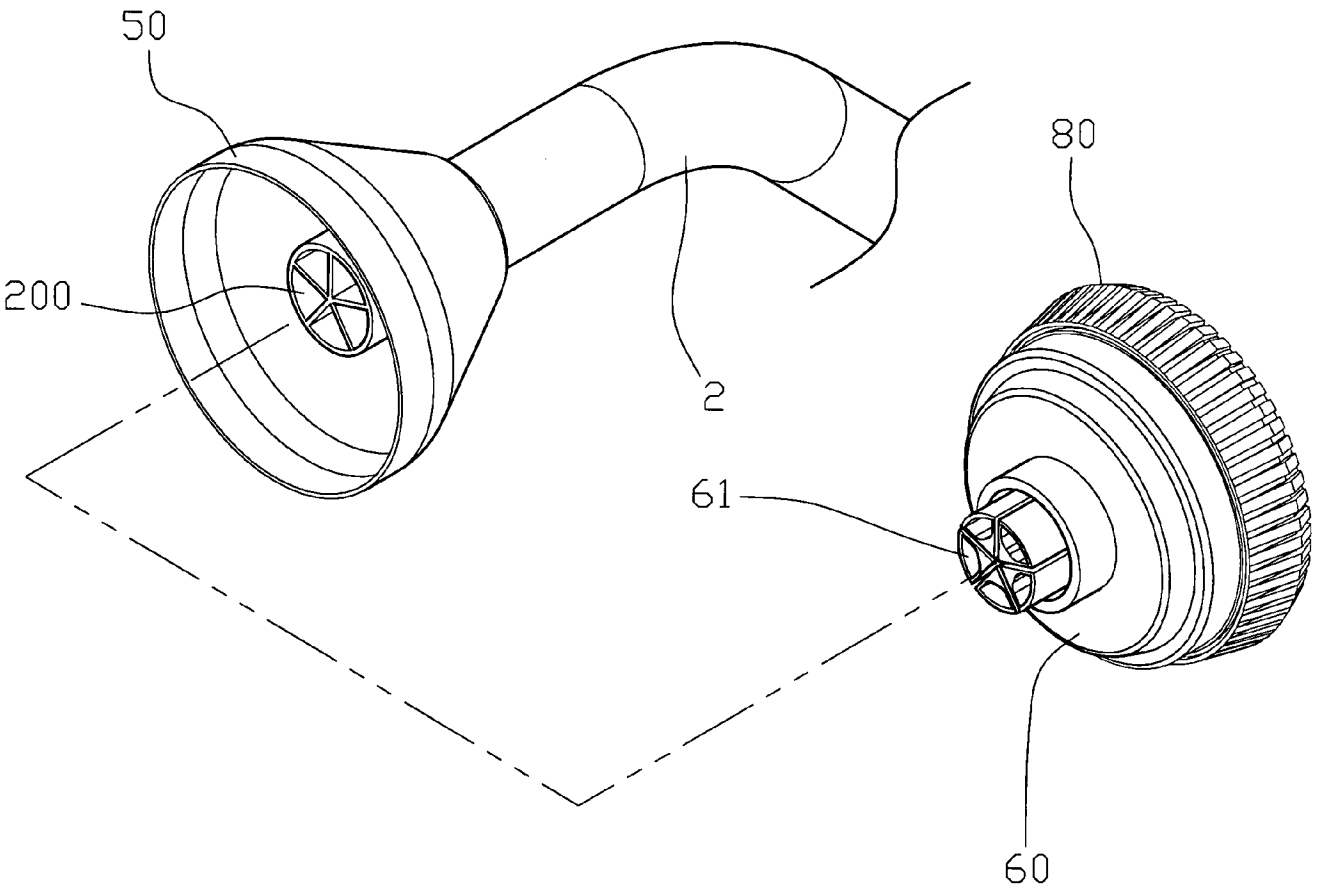
FIG. 5 is a partially exploded perspective view of the spraying gun as shown in FIG. 1.
Figure 6:
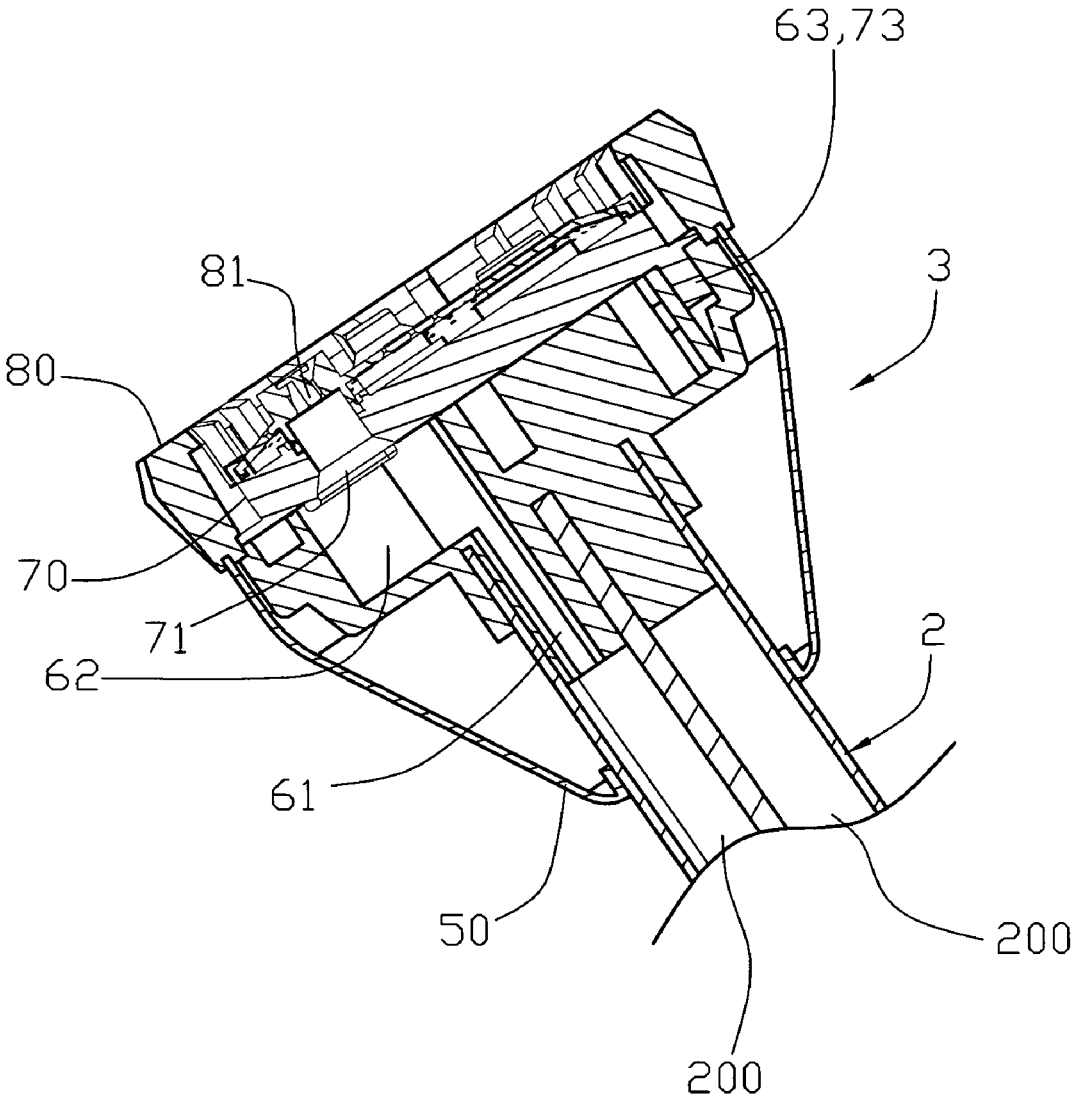
FIG. 6 is a locally enlarged view of the spraying gun as shown in FIG. 3.

Referring to FIGS. 4–6 with reference to FIGS. 1–3, the injection unit 3 includes a water guide member 60 mounted on the second end of the water guide pipe 2 and having a first side formed with a plurality of water inlet holes 61 each connected to a respective one of the water channels 200 of the water guide pipe 2 and a second side formed with a plurality of enlarged water outlet holes 62 each connected to a respective one of the water inlet holes 61, a water control plate 70 mounted on the water guide member 60 and formed with a plurality of water filling holes 71 each connected to a respective one of the water outlet holes 62 of the water guide member 60, a water injection ring 80 mounted on the water control plate 70 and formed with a plurality of nozzles 81 each connected to a respective one of the water filling holes 71 of the water control plate 70, and a shade 50 mounted on the second end of the water guide pipe 2 to cover the water guide member 60 and the water control plate 70.

The water guide member 60 has a periphery formed with a plurality of sockets 63, and the water control plate 70 has a periphery formed with a plurality of plugs 73 inserted into the sockets 63 of the water guide member 60, so that the water control plate 70 is secured on the water guide member 60. Each of the water filling holes 71 of the water control plate 70 has a periphery provided with a bonding line 72 bonded on a periphery of a respective one of the water outlet holes 62 of the water guide member 60 by a high frequency wave.

In operation, the water from either one of the water channels 200 of the water guide pipe 2 in turn flows through the respective water inlet hole 61 and water outlet hole 62 of the water guide member 60 and the respective water filling hole 71 of the water control plate 70 and is finally injected outward from the respective nozzle 81 of the water injection ring 80.

Accordingly, the control unit 1 can control the water from the feeding member 10 to flow into different water channels 200 of the water guide pipe 2, and the injection unit 3 has corresponding water inlet hole 61, water outlet hole 62, water filling hole 71 and nozzle 81 to align with the respective water channel 200 of the water guide pipe 2, so that different kinds of water flow are injected outward from the nozzles 81 of the injection unit 3 so as to change the sprinkling manner of the spraying gun, thereby enhancing the versatility of the spraying gun, and thereby preventing the injected water from wetting a user's clothes. In addition, the sprinkling manner of the injection unit 3 is adjusted and controlled by the control unit 1 arbitrarily, thereby facilitating the user adjusting the sprinkling manner of the spraying gun.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A spraying gun, comprising a water guide pipe having an inside formed with a plurality of water channels, a control unit mounted on a first end of the water guide pipe, and an injection unit mounted on a second end of the water guide pipe, wherein:

the injection unit includes:

a water guide member mounted on the second end of the water guide pipe and having a first side formed with a plurality of water inlet holes each connected to a respective one of the water channels of the water guide pipe and a second side formed with a plurality of enlarged water outlet holes each connected to a respective one of the water inlet holes;

a water control plate mounted on the water guide member and formed with a plurality of water filling holes each connected to a respective one of the water outlet holes of the water guide member;

a water injection ring mounted on the water control plate and formed with a plurality of nozzles each connected to a respective one of the water filling holes of the water control plate;

wherein the water guide member has a periphery formed with a plurality of sockets, and the water control plate has a periphery formed with a plurality of plugs inserted into the sockets of the water guide member, so that the water control plate is secured on the water guide member.

2. The spraying gun in accordance with claim 1, wherein each of the water filling holes of the water control plate has a periphery provided with a bonding line bonded on a periphery of a respective one of the water outlet holes of the water guide member by a high frequency wave.

3. A spraying gun. comprising a water guide pipe having an inside formed with a plurality of water channels, a control unit mounted on a first end of the water guide pipe, and an injection unit mounted on a second end of the water guide pipe, wherein:

the injection unit includes:

a water guide member mounted on the second end of the water guide pipe and having a first side formed with a plurality of water inlet holes each connected to a respective one of the water channels of the water guide pipe and a second side formed with a plurality of enlarged water outlet holes each connected to a respective one of the water inlet holes;

a water control plate mounted on the water guide member and formed with a plurality of water filling holes each connected to a respective one of the water outlet holes of the water guide member;

a water injection ring mounted on the water control plate and formed with a plurality of nozzles each connected to a respective one of the water filling holes of the water control plate;

a shade mounted on the second end of the water guide pipe to cover the water guide member and the water control plate.

4. A spraying gun, comprising a water guide pipe having an inside formed with a plurality of water channels, a control unit mounted on a first end of the water guide pipe, and an injection unit mounted on a second end of the water guide pipe, wherein:

the injection unit includes:

a water guide member mounted on the second end of the water guide pipe and having a first side formed with a plurality of water inlet holes each connected to a respective one of the water channels of the water guide pipe and a second side formed with a plurality of enlarged water outlet holes each connected to a respective one of the water inlet holes;

a water control plate mounted on the water guide member and formed with a plurality of water filling holes each connected to a respective one of the water outlet holes of the water guide member;

a water injection ring mounted on the water control plate and formed with a plurality of nozzles each connected to a respective one of the water filling holes of the water control plate;

wherein the control unit includes a feeding member, a fitting member, an adjusting member, wherein:

the feeding member of the control unit has an end provided with a mounting portion having an inside formed with a water outlet; the fitting member of the control unit is mounted on the mounting portion of the feeding member and has a first end formed with a water passage connected to the water outlet of the mounting portion of the feeding member and a second end mounted on the first end of the water guide pipe and formed with a plurality of water conduits each connected to a respective one of the water channels of the water guide pipe;

the adjusting member of the control unit is rotatably mounted on the first end of the fitting member and has a periphery formed with at least one water conducting hole connected to the water passage of the fitting member and selectively connected to either one of the water conduits of the fitting member.

5. The spraying gun in accordance with claim 4, wherein the mounting portion of the feeding member of the control unit has a periphery formed with an annular groove having a locking cavity, and the first end of the fitting member of the control unit is inserted into the groove of the mounting portion of the feeding member.

6. The spraying gun in accordance with claim 5, wherein the first end of the fitting member of the control unit has a locking block locked in the locking cavity of the groove of the mounting portion of the feeding member.

7. The spraying gun in accordance with claim 4, wherein the second end of the fitting member of the control unit has a periphery formed with a locking slot.

8. The spraying gun in accordance with claim 4, wherein the adjusting member of the control unit is located between the feeding member and the fitting member.

9. The spraying gun in accordance with claim 4, wherein the adjusting member of the control unit has an inside formed with a through hole mounted on the first end of the fitting member.

10. The spraying gun in accordance with claim 4, wherein the control unit further includes a jacket secured on the second end of the fitting member.

11. The spraying gun in accordance with claim 10, wherein the adjusting member of the control unit has an end formed with a plurality of positioning holes, and the jacket of the control unit has a bottom provided with a protruding positioning portion detachably positioned in either one of the positioning holes of the adjusting member.

* * * * *